US006431125B1

(12) United States Patent
Eriksson

(10) Patent No.: US 6,431,125 B1
(45) Date of Patent: Aug. 13, 2002

(54) DEVICE FOR REGULATING AND CLEANING AN AIR INTAKE

(75) Inventor: Tore Eriksson, Skutskär (SE)

(73) Assignee: LT-Produkter Skutskär AB, Skutskär (SE)

( * ) Notice: Subject to any disclaimer, the term of this patent is extended or adjusted under 35 U.S.C. 154(b) by 0 days.

(21) Appl. No.: 09/623,450

(22) PCT Filed: Mar. 3, 1999

(86) PCT No.: PCT/SE99/00307

§ 371 (c)(1),
(2), (4) Date: Sep. 5, 2000

(87) PCT Pub. No.: WO99/45323

PCT Pub. Date: Sep. 10, 1999

(30) Foreign Application Priority Data

Mar. 5, 1998 (SE) ..... 9800688

(51) Int. Cl.[7] ..... F28G 1/00

(52) U.S. Cl. ..... 122/379; 432/2; 432/75; 15/104.16; 15/104.18

(58) Field of Search ..... 122/379, 390; 432/2, 75; 15/104.05, 104.068, 104.16, 104.18

(56) References Cited

U.S. PATENT DOCUMENTS

| | | | | |
|---|---|---|---|---|
| 2,091,461 A | * | 8/1937 | Waack | 15/104.18 |
| 3,742,916 A | | 7/1973 | Wessberg et al. | |
| 4,099,471 A | * | 7/1978 | Sander et al. | 122/379 |
| 4,538,552 A | | 9/1985 | Smuda | |
| 5,531,189 A | * | 7/1996 | Shelton et al. | 122/379 |
| 5,809,603 A | * | 9/1998 | White | 15/104.18 |

FOREIGN PATENT DOCUMENTS

| | | |
|---|---|---|
| SE | 438372 | 4/1985 |

* cited by examiner

*Primary Examiner*—Jiping Lu
(74) *Attorney, Agent, or Firm*—Dilworth & Barrese LLP

(57) ABSTRACT

A device for regulating and cleaning an air port (3) arranged in the wall (2) of a furnace, especially a soda house furnace, comprises a cleaning arrangement (1) and an arrangement (4) for regulating the air flow through the air port, in which an air casing (5) is arranged around the air port on the outer side of the furnace wall, in which a drum (12) is arranged inside the air casing and air-tightly connected to the wall of the air casing located opposite to the furnace wall. An opening defined by at least a cover member (14) of the regulating arrangement and at least one lateral wall of the drum is arranged with a restricted extension in the circumferential direction of the drum so as to achieve an air jet in towards and through the air port (3).

19 Claims, 5 Drawing Sheets

DEVICE FOR REGULATING AND CLEANING AN AIR INTAKE

FIELD OF THE INVENTION AND PRIOR ART

The present invention relates to a device for regulating and cleaning an air port (3) arranged in a wall (2) of a furnace, especially a soda house furnace, comprising a cleaning arrangement (1), which in it turn comprises a cleaning member (7) movable with respect to the walls of the air port (3), and arrangement (4) for regulating the air flow through the air port (3), and air casing (5) being arranged around the air port (3) on the outer side of the furnace wall (2), a drum (12) being arranged inside the air casing (5) and connected to a wall (13) of the air casing (5) located opposite to the furnace wall (2), the cleaning arrangement (1) being also connected to the wall (13) of the air casing (5) and extending at least partially through the drum (12), the regulating arrangement having a cover member (14) movable with respect to the drum (12), the cleaning member (7) being movable between two end positions and independently of the position of the cover member (14), and the cleaning member (7) being in a first of the end positions located at least partially inside the furnace and a second of the end positions at least partially outside the furnace.

Such devices are used within the field of soda house furnaces and the like, in which the wall is provided with a plurality of air ports, the air flow of which has to be regulated and which sometimes have to be cleaned.

Within the cellulose industry the spent liquors from paper wood boiling (sulphate spent liquor and in some case sulphite spent liquor) are combusted for recovery in a recovery boiler. The nature of the fuel and the process conditions result in a tendency of plugging of the openings, through which combustion air is supplied, usually called air ports, through dust particles and flowing cinder products. These pluggings are more accentuated in the lower region of the air port and especially at the bottom thereof. There are different arrangements of cleaning members reciprocating in the air ports for cleaning thereof and which are activated upon need or periodically. It is important from the environmental point of view to achieve such a complete combustion as possible of the spent liquor located in the recovery boiler. The supply of air is an important parameter for this purpose. A regulating device is arranged for regulating the air supply through an air port. There are according to the prior art a number of examples of regulating devices and cleaning devices for furnace air ports.

According to a first example of the prior art the cleaning member has a sleeve shape and has also a task to regulate the air flow, which is achieved by the fact that the sleeve has a cross section having a shape and size corresponding to the air port, in which the air flow present in a slit between the cleaning member and the air port, which as such has a cleaning effect, is dependent upon how far the cleaning member is introduced into the air port in the resting position thereof. Such a device has the advantage that air will be supplied without any control, or at least intermittently during the cleaning operation.

According to a further example of the prior art the cleaning member has only a cleaning function, and a throttle is arranged for regulating the air supply. The throttle is here arranged on the outer side of the furnace wall close to the air port and may for example be constituted by a lid being moveable downwardly for covering the air port. When cleaning of the air port is to take place the lid has accordingly to be removed from the position thereof covering the air port at least partially, so that the cleaning member may be introduced into the air port. An uncontrolled flow of air into the air port during the cleaning thereof also takes place in this example.

According to a further example of the prior art, the cleaning device is at least partially enclosed in a drum, which extends from a wall located opposite to the furnace wall and belonging to an air casing arranged outside the airport, said drum extending from said wall in the direction towards the air port. The cleaning device is of a conventional type and comprises a cleaning member, a holding element and a power member, in which the cleaning member is arranged at one end of the holding element, said holding element being at a second and thereof actively connected to the power member, in which the cleaning member is moveable in a reciprocating movement with respect to the air port for cleaning the walls thereof. A sleeve is moveable along the length of the drum at an end thereof facing the air port. Said sleeve having an inner cross section shape corresponding to the outer cross section shape of the drum so as to seal around the drum and an at least somewhat larger cross section than the air port for also being able so seal therearound. By such a design the cleaning member may be brought to and fro through the air port while the sleeve is arranged in a position causing a suitable air flow to the air port. The air will then flow through a circumferential slot formed between the sleeve and the furnace wall located around the air port. As a consequence of the flow of non-combustible material and cinder products along an inner wall of the furnace and the tendency thereof to cause pluggings of the air port this may also reach the circumferential slot and at least partially plug it. Upon such a partially plugging of the slot air will flow in through the air port through portions of the slot not plugged, which on one hand results in a reduction of the controllability of the air flowing through the air port since changes of the position of the sleeve with respect to the air have to be carried out with increasing degree of plugging, and on the other the non-combustible material reaching the slot may immobilise the sleeve or at least create a resistance against movement thereof. The plugging of the air port will primarily take place at the bottom of the air port, since the flowing non-combustible material is collected on the bottom, which means that the immobilisation of the sleeve tends to take place of the portion of the sleeve intended to cover the bottom of the air port. As a consequence of the fact that the opening formed for the air flow is slot-like a comparatively short movement of the sleeve will result in a comparatively large change of the area of the opening, which means that a device with a high accuracy for the movement of the sleeve is required for obtaining a change desired of the amount of air flowing into the furnace per time unit.

SUMMARY OF THE INVENTION

The object of the present invention is to provide a device for regulating and cleaning an air port arranged in the wall of a furnace, which eliminates at least some of the drawbacks mentioned above in regulating and cleaning an air port according the conventional technique.

This object is according to the device according to the invention obtained by arranging the cover member for regulating the air flow through at least an opening defined by at least a lateral wall of the drum and having a restricted extension in the circumferential direction of the drum. By the fact that the at least one opening has a restricted extension in the circumferential direction of the drum the opening will not have any circumferential slot character, so that the problems defined above of an opening with a slot-shape are eliminated.

According to an embodiment, in which the cover member has at least a wall portion for at least partially cover the opening on movement of the cover member and where the cover member is movable substantially in the longitudinal direction of the opening, it is possible to make the shape of the effective open area of the opening almost point-like, in which the air flowing through the opening and further into through the air port may have a substantially jet-like character. Such an air jet means a higher degree of concentrated air amount with respect to the character of the air flowing in through a slot-like opening according to the prior art, which involves a number of advantages. Firstly, it will be easier to check and regulate the air flow into the furnace, and an air flow into the furnace being turbulent to a smaller extent is achieved due to the air jet, which in its turn means that the air flowing in may reach further into the furnace and may by that in a higher degree prevent particles incompletely combusted to flow up from the melt in a centre region of the furnace.

According to another embodiment of the invention, in which at least a portion of the opening is arranged on the level with a bottom of the air port, the air supply will in a higher degree take place along this bottom, which in its turn means that a clean flushing of cinder products from this bottom being stronger than in the prior art is achieved.

According to another embodiment of the invention, which constitutes a further development of the preceding embodiment, an end of the drum facing the air port is at least partially arranged at a distance from the furnace wall delimiting the air port, and an upper and a lower wall part having an extension in the transversal direction of the drum substantially corresponding to the width of the drum is adapted to connect the drum at the top and at the bottom, respectively, with the air port, which means that two openings oppositely located are formed in the transversal direction of the drum and between the furnace wall delimiting the air port, a lateral wall arranged in the transversal direction of the drum and said wall parts, respectively, and by the fact that the cover member has two substantially parallel wall portions which are arranged at a mutual distance substantially corresponding to the width of the drum. The cover member will upon a movement in parallel with the furnace wall delimiting the air port more or less cover the openings formed between the surface wall delimiting the air port, the lateral walls of the drum and said wall parts. This means that the cover member in a rest position allowing air supply through the openings is arranged at a distance from the bottom of the air port, and it is counteracted that the cover member gets stuck by possible cinder products gathered on the bottom of the air port.

BRIEF DESCRIPTION OF THE DRAWINGS

With reference to the appended drawings, below follows a detailed description of preferred embodiments of the invention cited as examples.

In the drawings.

DETAILED DESCRIPTION OF PREFERRED EMBODIMENTS OF THE INVENTION

Figure 1:
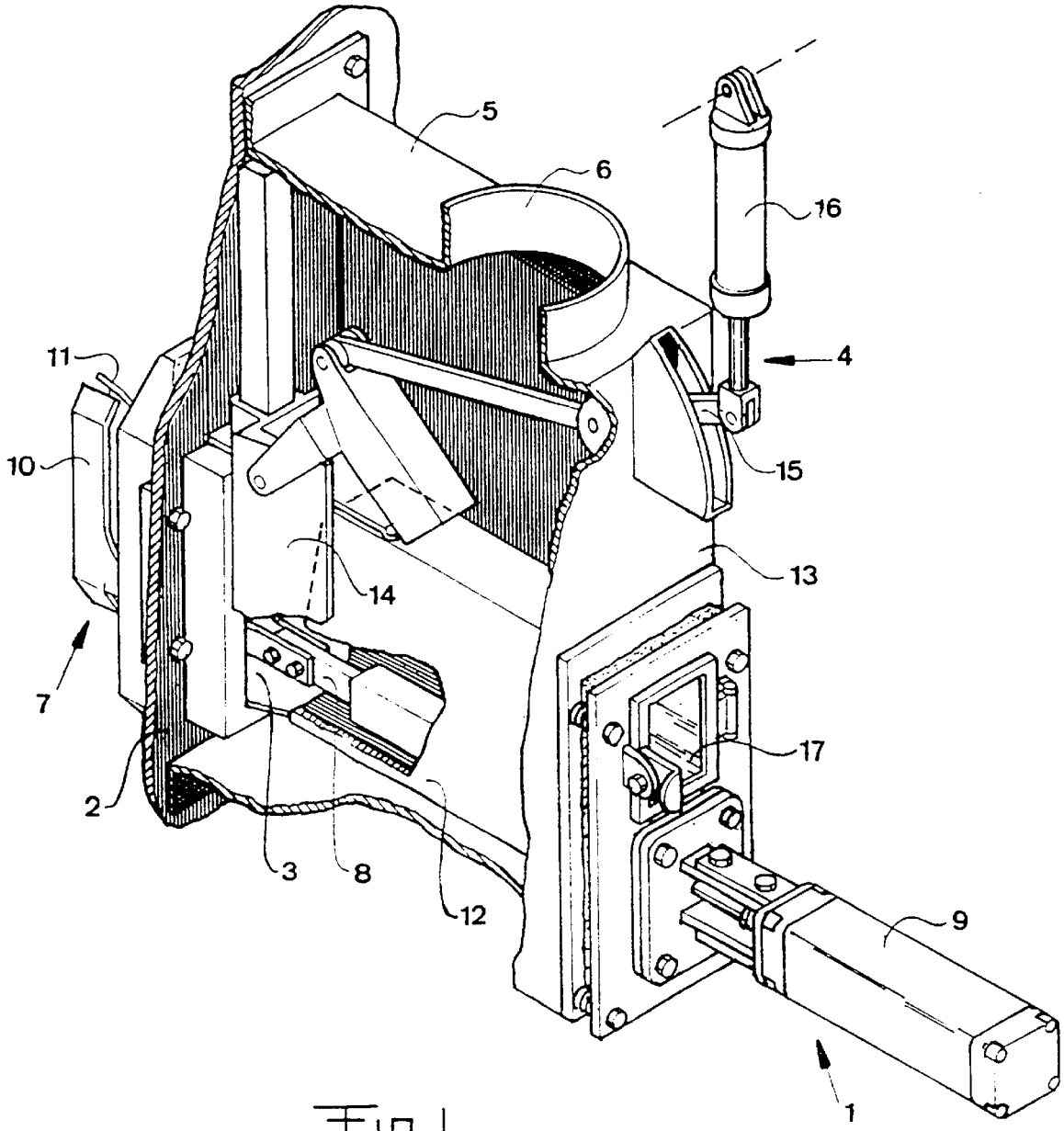
FIG. 1 shows a partially sectioned perspective view of the device according to the invention according to a first preferred embodiment.

A partially sectioned perspective view of the device according to the invention according to a first preferred embodiment is illustrated in FIG. 1. The device comprises on one hand an arrangement 1 for cleaning an air port 3 arranged in a wall 2 of a furnace from dust particles and flowing cinder products from the interior of the furnace, and on the other an arrangement 4 for regulating the flow of air through the air port 3.

The furnace is especially a soda house furnace, and the device is especially suited for regulating and cleaning air ports of such a soda house furnace, but also other applications are conceivable for the device according to the invention. Such a soda house furnace or recovery boiler comprises a number of such air ports distributed around the furnace wall above the level of the spent liquor located in the furnace. A first series of air ports are called primary air ports, and a second and a third series of air ports on levels in a vertical direction above the first series are called secondary air ports and tertiary air ports, respectively, and so on. The device according to the invention is applicable to any of these series of air ports. A regulating and cleaning device is arranged for each of the air ports.

On the outer side of the furnace wall 2 a closed so called air casing or cabinet 5 is arranged around the air port 3. This is in the case shown secured to the furnace wall 2. The air casing 5 has an inlet 6 for hot air, which leaves the air casing through the air port 3 for combustion of the spent liquor inside the furnace. It is then possible that an air casing is arranged for each air port or that one air casing encloses several or even all the air ports arranged on a certain level around the furnace. The air casing is suitably provided with an amount of air inlets.

The cleaning arrangement 1 comprises a cleaning member 7, a holding element 8 and a power member 9, said cleaning member being arranged at one end of the holding element, and the holding element is at a second end actively connected to the power member. The cleaning member 7, which with respect to the shape corresponds to the air port 3 but to the dimension is slightly smaller than this, is moveable through the power member 9 through two end positions, in which the cleaning member in a first end position is located at least partially inside the furnace and in a second end position at least partially outside the furnace. The cleaning member 7 is in FIG. 1 arranged with the active cleaning elements 10, 11 thereof inside the furnace. When the cleaning member 7 is moved between said two end positions the cleaning elements will be biased against at least the two walls arranged in the transversal direction of the air port and by that remove dust particles and cinder products from the spent liquor deposited thereon. The power member is constituted by a piston/cylinder assembly. The detail design and function of the cleaning member will be described more in detail in connection with FIGS. 5–7.

An arrangement 4 for regulating the flow out through the air port 3 comprises a drum 12, a cover member 14 and a regulating mechanism 15. The drum 12 is preferably substantially air-tightly connected to an outer wall 13 of the air casing located opposite to the air port 3. Parts of the regulating arrangement 1 extend through the drum 12. According to the first preferred embodiment of FIG. 1 the cover member 14 is movable in the vertical direction by means of the regulating mechanism 15. The regulating mechanism 15 has for this purpose a power member 16. Also this power member is constituted by a piston/cylinder assembly.

It is by that possible to move the cleaning member by means of the device according to the invention independently of the position of the cover member 14 between said two end positions. This means that the cleaning of the air port may be carried out by means of the cleaning member while the cover member is arranged in a determined position, in which it allows a controlled air flow desired in through the air port. By the fact that the cover member 14 not in any position covers any part of the air port as seen from the inside of the drum 12, it is possible to look at the entire air port 3, and also look into the interior of the furnace, at any time through a viewing window 17.

The drum 12 has a substantial rectangular cross section with a sufficient height and width for being able to receive the cleaning member 7 when this is retracted to a rear end position.

Figure 2:
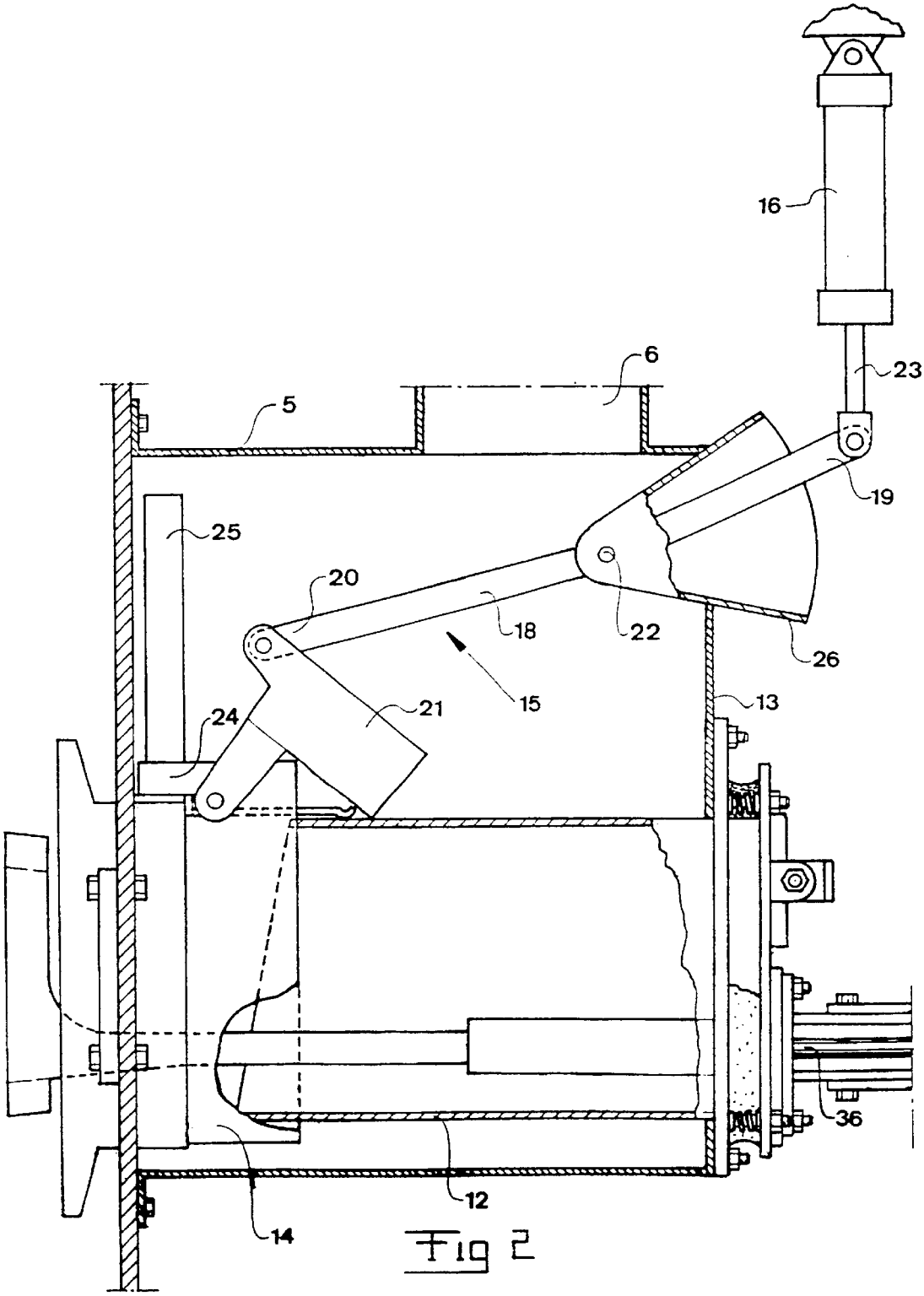
FIG. 2 shows a partially sectioned lateral view of the device according to the invention, where the cover member is arranged in a first position, in which it totally covers openings formed between the drum the furnace wall.

FIG. 2 illustrates the device according to the invention according to FIG. 1. The cover member 14 is arranged in a lower end position. The regulating mechanism 15 for moving the cover member 14 in the vertical direction has a lever 18, which at one end 19 thereof is pivotally and actively connected to a piston rod 23 of a power member 16 and at the other end 20 thereof is pivotally connected to a power transmitting part. The lever 18 is also suspended in and pivotable around a point 22. The power transmitting part 21 is in its turn connected to the cover member 14. The power member 16 is constituted by a power cylinder, which may cause a movement in the vertical direction of the cover member 14 by displacing the piston rod 23 thereof through the lever 18 and the power transmitting part 21. An upper portion 24 of the cover member 14 embraces a vertical rod 25 and is slideably displaceable along this rod. The first end 19 of the lever 18 may by means of the power member 16 be moved between two end positions. A circle sector-like part 26 extending through the wall 13 of the air casing 5 has a slot for receiving the lever 18. The circle sector-like part has an arc angle being sufficient for allowing a movement of the first end 19 of the lever between two end positions corresponding to the two end positions of the cover member 14. The lever 18 is also air-tightly connected to the circle sector-like part 26.

Figure 3:
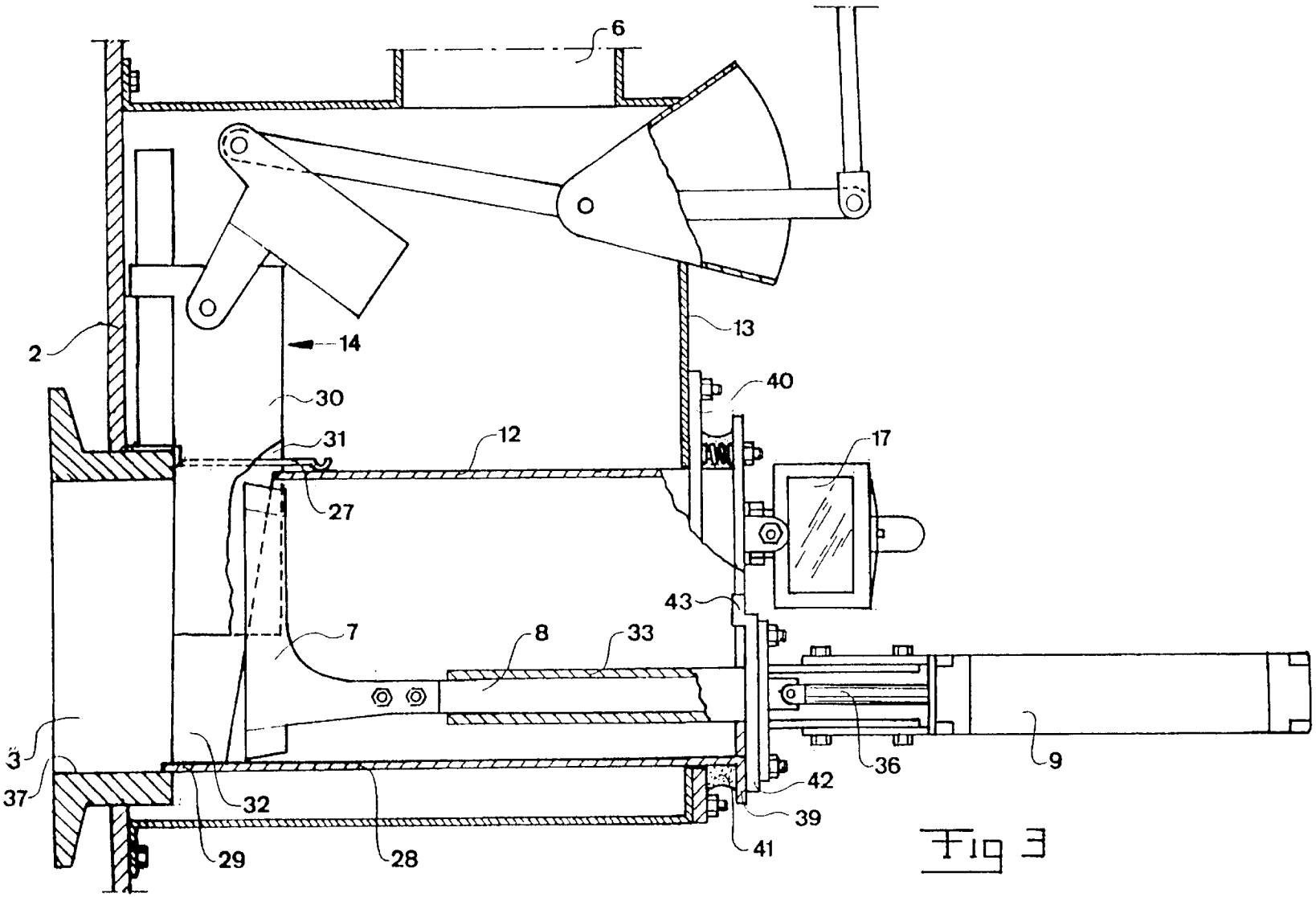
FIG. 3 is a partially sectioned lateral view of the device according to the invention according to the first preferred embodiment, where the cover member is arranged in the second position, in which it forms openings between the drum, the furnace wall and itself.

FIG. 3 illustrates the device, where the cover member 14 is located in an upper position. The cleaning member 7 is also arranged in the rear end position thereof. The movement of the cleaning member 7 between these two end positions may take place independently of the position of the cover member 14. An upper wall part 27 having an extension in the transversal direction of the drum 12 substantially corresponding to the width of the drum is arranged for connection of the drum at the top with the furnace wall 2 delimiting the air port 3. Also the frame portion extending around the air port 3 in the direction towards the interior of the air casing 5 is comprised by the furnace wall 2. A lower lateral wall 28 of the drum 12 extends at least partially into the air port 3, in which the drum partially is carried of said frame portion, and receives the control in the transversal direction thereof. By said upper wall part 27 and the lower wall part 29 extending from the lower lateral wall 28 the space located between the drum 12 and the air port 3 is delimited upwardly and downwardly, respectively.

The cover member 14 has two substantially parallel wall portions 30, 31, which are arranged at a mutual distance substantially corresponding to the width of the drum 12 so as to at least partially cover the openings 32 located between the furnace wall 2 delimiting the air port, the lateral walls of the drum in the transversal direction and said wall parts 27, 29 when the cover member 14 is moved. When the cover member 14 is moved from the position shown in FIG. 2 to the position shown in FIG. 3 the openings 32 have an increasing efficient opening area. The respective opening 32 has a shape causing a flow of air in through the air port 3 with the character of an air jet. Lower parts of wall portions 30, 31 of the cover member 14 are by that arranged at a distance in a vertical direction above the bottom 37 of the air port, when the cover member is arranged in a position allowing an air flow into the air port.

The definition lateral wall of the drum as used above and in the claims is intended to comprise walls in a transversal direction of the drum as well as in the vertical direction thereof.

The drum 12 is secured, for example by a welded joint, to a first plate 39, which is arranged on an outer side of the wall 13 arranged opposite to the air port. The first plate 39 is connected to a second plate 40, which in its turn is releasably connected to the wall 13. The second plate 40 has a hole for receiving the drum and is arranged around a hole through the wall 13 of the air casing 5 also intended for receiving the drum. The drum 12 will in an active position by that extend through both the second plate and the wall 13. The second plate 40 is through for example a screw joint connected to the wall 13. The first plate 39 may be orientated with respect to the second plate 40 so as to allow a certain possibility to orientate the drum 12 in the air casing 5. This possibility to orientate is achieved by the fact that the first plate 39 is connected to the second plate 40 through a screw/spring joint while a sealing means 41 is arranged between the plates. By tightening the screws of the screw/spring joint a desired orientation of the first plate 39 with respect to the second plate 40 and by that a desired orientation of the drum in the air casing may be obtained.

The cleaning member 7 is as mentioned above rigidly connected to a holding element 8, which in its turn is guided in a hollow beam member 33 extending from a third plate 42. The third plate 42 is releasably connected to an outer side of the first plate 39 covering the lower region of a hole provided through said first plate, which hole constitutes a prolongation of the inner space of the drum 12, so that the beam member 33 extends through the drum 12 in the direction towards the air port 3. Furthermore, the viewing window 17 is arranged above the third plate 42 on the outer side of the first plate 39 covering an upper region of the hole provided through the first plate. Furthermore, the third plate 42 has a hole for receiving the holding element 8 and is provided with an angle at the upper end thereof for making the viewing window to overlap the upper end, which results in a good covering of the hole of the first plate. The upper end of the third plate 42 is provided with a lip 43, see also FIG. 4.

The driving member 9 of the cleaning arrangement 1 is in its turn rigidly connected to the third plate 42, and the holding element 7 is movably received in the hole of the third plate 42.

It is important that the beam member 7 may be moved back to a position at a comparatively great distance to the air port 3, see FIG. 3, since the temperature in the furnace is extremely high, approximately in the interval 750–1100° C., and would the cleaning member 7 be arranged in the rear resting position in a position in or in the immediate proximity of the air opening 3, the cleaning member would be excerted to severe stresses and after some time be deformed and/or dissociated as a consequence of the high temperature. However, the air flowing in through the opening 6 has a considerably lower temperature, for example in the interval from 150–225° C., and the cleaning member 7 is cooled by this air.

The piston rod 36 of the power member 9 is rigidly connected to the holding element 8. The holding element is in FIG. 3 reciprocatingly received in a hole through the third plate 42. According to an alternative, which is shown in FIGS. 1 and 2, the piston rod 36 is instead reciprocatingly received in a hole made for this through the third plate 42.

Figure 4:
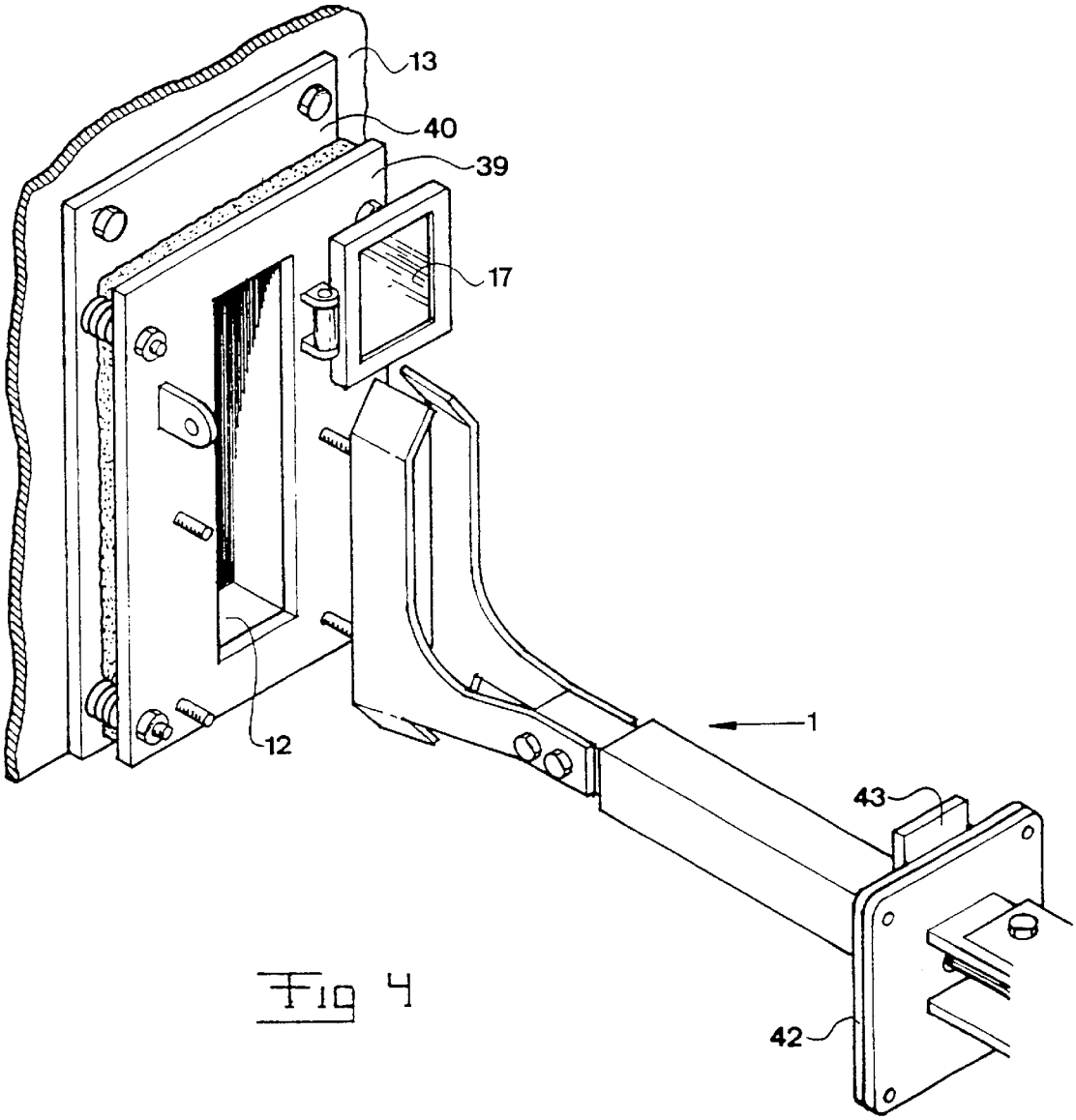
FIG. 4 is a perspective view of the cleaning arrangement in a position removed from the air casing.

FIG. 4 illustrates the releasable connection of the cleaning arrangement 1 to the outer wall 13 of the air casing described above. As a consequence of the releasability it is easy to remove the cleaning arrangement from the air casing, which is important should for example the cleaning member fail. When the cleaning arrangement 1 is withdrawn from the air casing the viewing window 17 will be arranged in a position pivoted upwardly. It is then easy to take out the drum 12 from the air casing should this be desired thanks to the releasable connection of the second plate 42 to the outer wall 13 also described above.

The first preferred embodiment of the invention described above is only an example of a constructive design of the invention and the invention may accordingly be realised in a plurality of different ways while maintaining the basic inventional idea. It is in particular pointed out that men with skill in the art may after gaining knowledge about the solution according to the invention of course be able to carry out different modifications of the embodiment described as an example without departing from the scope of the patent protection.

The drum 12 may for example within the scope of the claims according to the invention have a cross section being different than rectangular. The function of the drum is to at least partially form at least an opening for flowing of air in to the air port 3 and for the rest act sealingly against flow of air in from the interior of the air casing 5, so that the flow of air into the air port 3 may be regulated by at least partially covering the opening by means of the covering member 14.

The opening intended for air flowing in and defined by at least one lateral wall of the drum is adapted to extend around more than half of the circumference of the drum. According to the first preferred embodiment of the invention two oppositely located openings are arranged, but also one, three or more openings are possible. By the arrangement of the cover member movable in the longitudinal direction of the opening an efficient opening area defined by at least the cover member 14 and at least a lateral wall of the drum may be formed by the opening with a shape being substantially different than a slot. The effective part of the opening is intended to have such a shape that the air flowing through the opening and further on towards the air port 3 will form a concentrated shape, such as for example an air jet. By arranging the opening/openings in close connection to the air port the air jet flowing through the opening will in a higher degree be concentrated when it flows through the air port than should the opening have been arranged at a greater distance to the air port.

As a consequence of the arrangement of the effective opening on a level corresponding to the lower region of the air port the air will flow out through the air port to a large extent in this lower region, and to a small extent through an upper region of the air port, which means a high concentration of air in the lower region, which counteracts gathering of cinder products in the lower region. Such an air concentration is also desired in cases when air flowing into the furnace should reach comparatively far into the furnace. According to the prior art, where air flows in through a slot-like opening arranged on the outside of the furnace wall around the air port the air flowing in will normally not reach the centre of the furnace, which means that the supply of air to the combustion will be non-uniform as seen in a cross section of the furnace and concentrated in the region close to the inner walls of the furnace.

In the first preferred embodiment of the invention described above the opening 32 has an extension substantially in the vertical direction of the drum and the cover member is by that also arranged movable in said direction. However, it is within the scope of the claims according to the invention to have the opening extending substantially in the longitudinal direction of the drum and according to a further embodiment the cover member is arranged movable substantially in the longitudinal direction of the drum.

Figure 5:
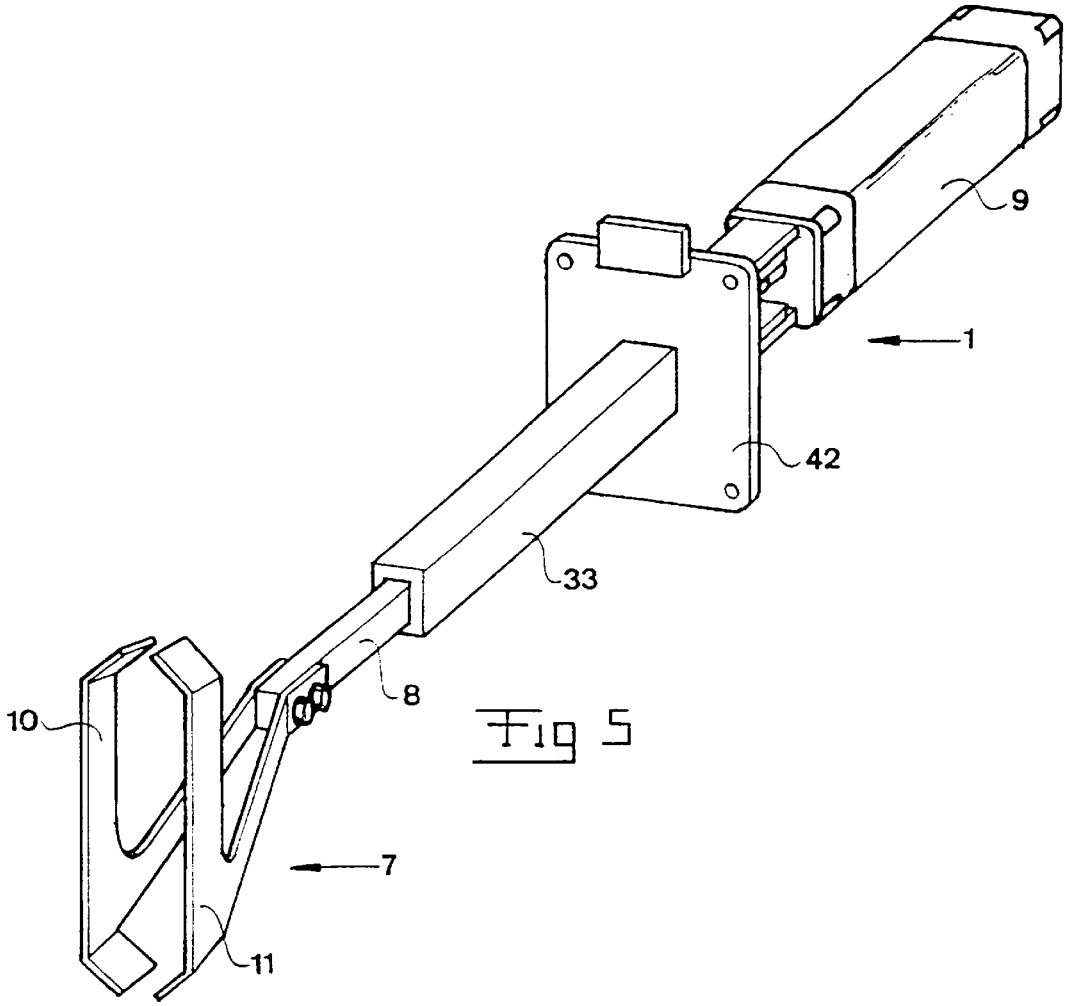
FIG. 5 is a perspective view of the cleaning arrangement according to the invention.

FIG. 5 illustrates a perspective view of the cleaning arrangement according to the invention, which is arranged through the third plate 42 mentioned above. The cleaning arrangement 1 comprises, as already mentioned, the cleaning member 7, the holding element 8 and the power member 9. The holding element 8 is through the power member 9 reciprocatingly guided in the beam member 33 connected to the plate 42. The cleaning member 7 has resilient properties in at least the transversal direction of the air port. The cleaning member 7 has also two cleaning elements 10, 11 being resilient with respect to each other in the transversal direction of the air port. The cleaning elements 10, 11 has a shape diverging from the holding element 8 in a resting position, in which they may be arranged in a position with a smaller mutual distance than in the resting position while storing potential energy. The cleaning elements are also arranged to store potential energy when moving from a position inside the furnace to a position in the air port. The cleaning elements 10, 11 will by that bear against the inner delimiting walls of the air port when the cleaning member is located in the air port, and they will carry out a scraping of the delimiting walls of the air port in the transversal direction when the cleaning member is moved. A very good cleaning of the delimiting walls of the air port in the transversal direction of the latter is obtained in this way.

The cleaning member 7 is also intended to have such an extension in the vertical direction of the air port that a scraping of the walls delimiting the air port in the vertical direction of the air port also are excerted to a cleaning or scraping when moving the cleaning member with respect to said limiting walls.

The function of the device according to the invention for cleaning an air port is as follows: Automatically and at predetermined intervals or upon need the power member 9 is controlled by any suitable regulating assembly to bring the holding element 8 to and fro and the cleaning member is by that moved to and fro in the air port for removing dust particles and cinder products from the spent liquor of the furnace from the delimiting walls of the air port and from front surfaces facing the interior of the furnace.

Figure 6:
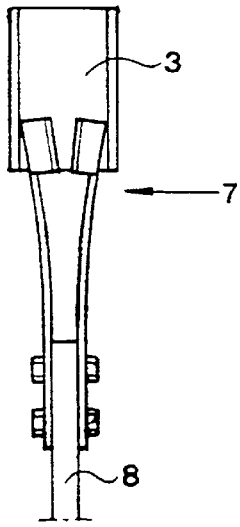
FIG. 6 shows the cleaning member in a position in which it's active front cleaning element is arranged inside the air port.
Figure 7:
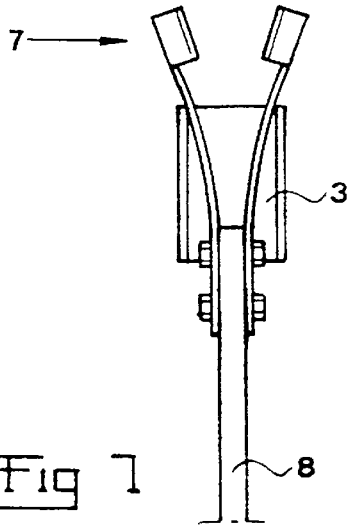
FIG. 7 shows the cleaning member in a position in which the active front cleaning element is arranged inside the furnace.

FIGS. 6 and 7 shows the cleaning member 7, when this is located in the air port 3 and inside the furnace, respectively, in which the cleaning member 7 when located inside the furnace is arranged in a state moved outwardly through the resilience.

However, the cleaning member may within the scope of the claims according to the invention also have a shape differing from two cleaning elements resilient in the transversal direction of the air port, for example a sleeve shape.

According to a further embodiment the drum is also air-tightly connected to the furnace wall 2 around the air port. The drum has in such a case at least one opening through at least one of the lateral walls thereof.

What is claimed is:

1. A device for regulating and cleaning an air port (3) arranged in a wall (2) of a furnace, especially a soda house furnace, comprising a cleaning arrangement (1), which in its turn comprises a cleaning member (7) movable with respect to the walls of the air port (3), and an arrangement (4) for regulating the air flow through the air port, an air casing (5) is arranged around the air port on the outer side of the furnace wall, a drum (12) being arranged inside the air casing and connected to a wall (13) of the air casing located opposite to the furnace wall, said cleaning arrangement being also connected to said wall of the air casing and extending at least partially through the drum, said regulating arrangement having a cover member (14) movable with respect to the drum, said cleaning member being movable between two end positions independently of the position of the cover member, and said cleaning member being in a first of the end positions located at least partially inside the furnace and in a second of the end positions at least partially outside the furnace, characterized in that the cover member (14) is arranged for regulating the air flow through at least one opening (32) defined by at least one lateral wall of the drum (12) and having a restricted extension in the circumferential direction of the drum.

2. A device according to claim 1, characterized in that the opening (32) extends over less than half of the circumference of the drum (12).

3. A device according to claim 1 characterized in that the opening (32) is arranged close to the air port (3).

4. A device according to claim 1, characterized in that the cover member (14) has at least one wall portion (30, 31), which is adapted to at least partially cover the opening (32).

5. A device according to claim 1, characterized in that the cover member (14) is movable substantially in the longitudinal direction of the opening.

6. A device according to claim 1, characterized in that the cover member (14) is arranged to be moved along the drum (12) in the longitudinal direction thereof.

7. A device according to claim 1, characterized in that the drum (12) has a substantially rectangular cross section.

8. A device according to claim 7, characterized in that an end of the drum (12) facing the air port (3) is at least partially arranged at a distance from the furnace wall (2) delimiting the air port.

9. A device according to claim 7, characterized in that the cover member (14) is arranged to be moved substantially in parallel with the furnace wall (2) delimiting the air port (3).

10. A device according to claim 7, characterized in that an upper and a lower wall part (27, 29) having an extension in the transversal direction of the drum (12) substantially corresponding to the width of the drum are arranged for connecting the drum at the top and the bottom, respectively, to the air port (3).

11. A device according to claim 10, characterized in that the cover member (14) has two substantially parallel wall portions (30, 31), which are arranged at a mutual distance corresponding to substantially the width of the drum (12) for at least partially covering the openings (32) formed between the furnace wall (2) delimiting the air port (3), the lateral walls of the drum and said wall parts (27, 29) upon movement of the cover member.

12. A device according to claim 1, characterized in that also the furnace wall (2) delimiting the air port (3) is adapted to define said opening (32).

13. A device according to claim 1, characterized in that at least a portion of the opening is arranged on a level with a bottom (37) of the air port (3).

14. A device according to claim 1, characterized in that the cleaning member (7) has resilient properties in at least the transversal direction of the air port (3).

15. A device according to claim 14, characterized in that the cleaning member (7) is adapted to store potential energy by bearing against inner walls of the air port upon a movement from a position inside the furnace to a position in the air port.

16. A device according to claim 14, characterized in that the cleaning member (7) has a shape diverging in the direction of the air port towards the furnace.

17. A device according to claim 14, characterized in that the cleaning member (7) has two cleaning elements (10, 11) resilient with respect to each other in the transversal direction of the air port (3).

18. A device according to claim 1, wherein said cover member (14) is at least partially hollow to permit insertion and retraction of said cleaning member (7) there through at all times.

19. A cleaning arrangement (4) for keeping an air port (3) arranged in a wall (2) of a furnace, especially a soda house furnace, clean, which comprises a cleaning member (7), a holding element (8) for holding the cleaning member (7) at a first end thereof, and a power member (9), which is actively connected to the holding element (8) at a second end thereof for removing the cleaning member (7) through the holding element (8) with respect to inner walls of the air port (3), said cleaning member (7) being movable between two end positions, and said cleaning member structured and arranged to be in a first end position located at least partially inside the furnace and a second end position at least partially outside the furnace, characterized in that the cleaning member (7) has resilient properties at least in a transverse direction of the air port (3), a beam (33) fixedly mounted upon said powers member (9), with said holding element (8) arranged to reciprocate out from and into said beam member (33), and comprising two cleaning elements (10, 11) mounted upon an end of said holding element (8) opposite said beam (33), said cleaning elements (10,11) being resilient with respect to each other and in the transverse direction of the air port (3), said cleaning elements (10,11) possessing a shape diverging from said holding element (8) in a resting position, in which said cleaning elements (10,11) may be arranged in a position with a smaller mutual distance therebetween than in the resting position, while storing a potential energy, and said cleaning elements (10,11) also being arranged to store the potential energy when moving from a position inside the furnace to a position in the air port (3) such that the cleaning elements (10,11) bear against inner delimiting walls of the air port (3) when the cleaning member (7) is located within the air port (3), and said cleaning elements (10,11) carry out a scraping action to and fro against the delimiting walls of the air port (3) in the transverse direction when the cleaning member (7) is moved.

* * * * *